US009954298B2

(12) United States Patent
Torcheux et al.

(10) Patent No.: US 9,954,298 B2
(45) Date of Patent: Apr. 24, 2018

(54) ELECTRICAL CONNECTOR WITH POSITIONING MEANS

(71) Applicant: Valeo Systemes de Controle Moteur, Cergy-Pontoise (FR)

(72) Inventors: Bertrand Torcheux, Thiverval Grignon (FR); Aurélien Pouilly, Conflans Sainte Honorine (FR)

(73) Assignee: Valeo Systems de Controle Moteur, Cergy-Pontoise (FR)

( * ) Notice: Subject to any disclaimer, the term of this patent is extended or adjusted under 35 U.S.C. 154(b) by 0 days.

(21) Appl. No.: 15/326,258

(22) PCT Filed: Jul. 8, 2015

(86) PCT No.: PCT/FR2015/051886
§ 371 (c)(1),
(2) Date: Jan. 13, 2017

(87) PCT Pub. No.: WO2016/009129
PCT Pub. Date: Jan. 21, 2016

(65) Prior Publication Data

US 2017/0201037 A1 Jul. 13, 2017

(30) Foreign Application Priority Data

Jul. 16, 2014 (FR) ..... 14 56809

(51) Int. Cl.
*H01R 31/08* (2006.01)
*H01R 13/11* (2006.01)
(Continued)

(52) U.S. Cl.
CPC ..... *H01R 13/113* (2013.01); *H01R 13/20* (2013.01); *H01R 31/08* (2013.01); *H01R 33/88* (2013.01); *H01R 13/187* (2013.01); *H01R 31/06* (2013.01)

(58) Field of Classification Search
CPC ..... H01R 31/08; H01R 31/06; H01R 13/187
(Continued)

(56) References Cited

U.S. PATENT DOCUMENTS 4,383,724 A * 5/1983 Verhoeven ..... H01R 31/08 439/510
4,900,271 A 2/1990 Colleran et al.
(Continued)

FOREIGN PATENT DOCUMENTS

DE 20 2007 016270 U1 1/2008
EP 0454205 A2 10/1991

OTHER PUBLICATIONS

International Search Report issued in PCT/FR2015/051886, dated Sep. 30, 2015 (3 pages).
(Continued)

*Primary Examiner* — Abdullah Riyami
*Assistant Examiner* — Justin Kratt
(74) *Attorney, Agent, or Firm* — Osha Liang LLP

(57) ABSTRACT

The electrical connector (122) comprises: a body (124), a first contact (126) fixed to the body (124) and designed to contact a first electrical conductor (123), a second contact (134) fixed to the body (124) and designed to contact a second electrical conductor (112).

The electrical connector (122) also comprises a system (142, 144) attaching the electrical connector (122) to the second electrical conductor (112), the attachment system (142, 144) being separate from the second contact (134).

16 Claims, 4 Drawing Sheets

(51) Int. Cl.

| | |
|---|---|
| ***H01R 33/88*** | (2006.01) |
| ***H01R 13/20*** | (2006.01) |
| *H01R 13/187* | (2006.01) |
| *H01R 31/06* | (2006.01) |

(58) Field of Classification Search
USPC ..... 439/654, 845, 849
See application file for complete search history.

(56) References Cited

U.S. PATENT DOCUMENTS

| | | | |
|---|---|---|---|
| 4,983,132 | A | 1/1991 | Weidler |
| 6,932,659 | B1 | 8/2005 | Wong |

OTHER PUBLICATIONS

Written Opinion of the International Searching Authority issued in PCT/FR2015/051886, dated Sep. 30, 2015 (6 pages).

* cited by examiner

ELECTRICAL CONNECTOR WITH POSITIONING MEANS

TECHNICAL FIELD

This invention concerns the field of electrical connectors.

TECHNOLOGICAL BACKGROUND

In the description that follows, the elements will be positioned in relation to a coordinate system defining arbitrary up/down (U-D), right/left (R-L) and forward/backward (F-B) directions.

The publication of European Patent Application EP 0 454 205 A2 describes a dual-insertion electrical connector comprising two pairs of wings fixed on either side of a central body. The two wings of each pair are designed to receive, between them, a conductive strip moving the two wings apart to provide a good electrical contact between the conductive strip and the electrical connector. The latter thus allows two conductive strips to be connected to one another.

The electrical connector described in the above publication has the drawback of having to be fixed to a support to hold it in place. This fixing on the support requires additional steps of assembly as well as additional fixing elements, which make the electrical connector more complex.

The aim of this invention is to propose an electrical connector designed to electrically connect together two external contacts that can be held in place simply.

SUMMARY OF THE INVENTION

To this end, an electrical connector is proposed designed to connect two electrical conductors together electrically, the electrical connector comprising:

- a body,
- a first contact fixed to the body and designed to contact the first electrical conductor,
- a second contact fixed to the body and designed to contact the second electrical conductor, characterized in that it also comprises a system attaching the electrical connector to the second electrical conductor, the attachment system being separate from the second contact.

Thanks to the invention, the electrical connector is held in place on the second electrical conductor, so that the step of fixing to a support is avoided.

Optionally, the second contact is a female contact.

Also optionally, the second contact comprises at least one clamp.

Also optionally, the attachment system comprises at least one hook fixed to the body and designed to engage in a cavity made in the second electrical conductor in order to hold the electrical connector on the second electrical conductor.

Also optionally, the second contact comprises two clamps and the, in particular each, hook is located between the two clamps.

Also optionally, the attachment system comprises two hooks, extending facing one another and between which the second electrical conductor is designed to be inserted.

Also optionally, the first contact is a female contact.

Also optionally, the first contact comprises at least one clamp.

Also optionally, the two contacts are located respectively on two opposite sides of the body.

Also optionally, the body, the two contacts and the attachment system are formed from one plate or sheet of metal, folded and/or stamped.

An electrical connection comprised as follows is also proposed:

- a chamber comprising walls delimiting an opening into an internal space of the chamber,
- an electrical conductor passing through one of the walls of the chamber so as to have one part, called the outer part, on the outside of the chamber and one part, called the internal part, extending into the internal space of the chamber,
- an electrical connector according to the invention, designed to be inserted at least partly into the internal space of the chamber through the opening of the chamber, and in which the second contact is designed to contact the internal part of the electrical conductor.

Optionally, the electrical conductor passes through the wall of the chamber in a sealed manner, and the opening of the chamber is the only unsealed opening of the chamber.

Also optionally, the chamber also comprises at least one ledge extending into the internal space of the chamber and designed to stop the electrical connector in the internal space of the chamber.

Also optionally, the internal part of the electrical conductor is equipped with one or more cavities in which the hook or hooks are respectively designed to engage.

DESCRIPTION OF THE FIGURES

An embodiment of the invention will now be described solely by way of example, with reference to the following figures.

DETAILED DESCRIPTION

With reference to FIGS. 1 to 4, an electrical connection system 100 implementing the invention will now be described.

Figure 1:
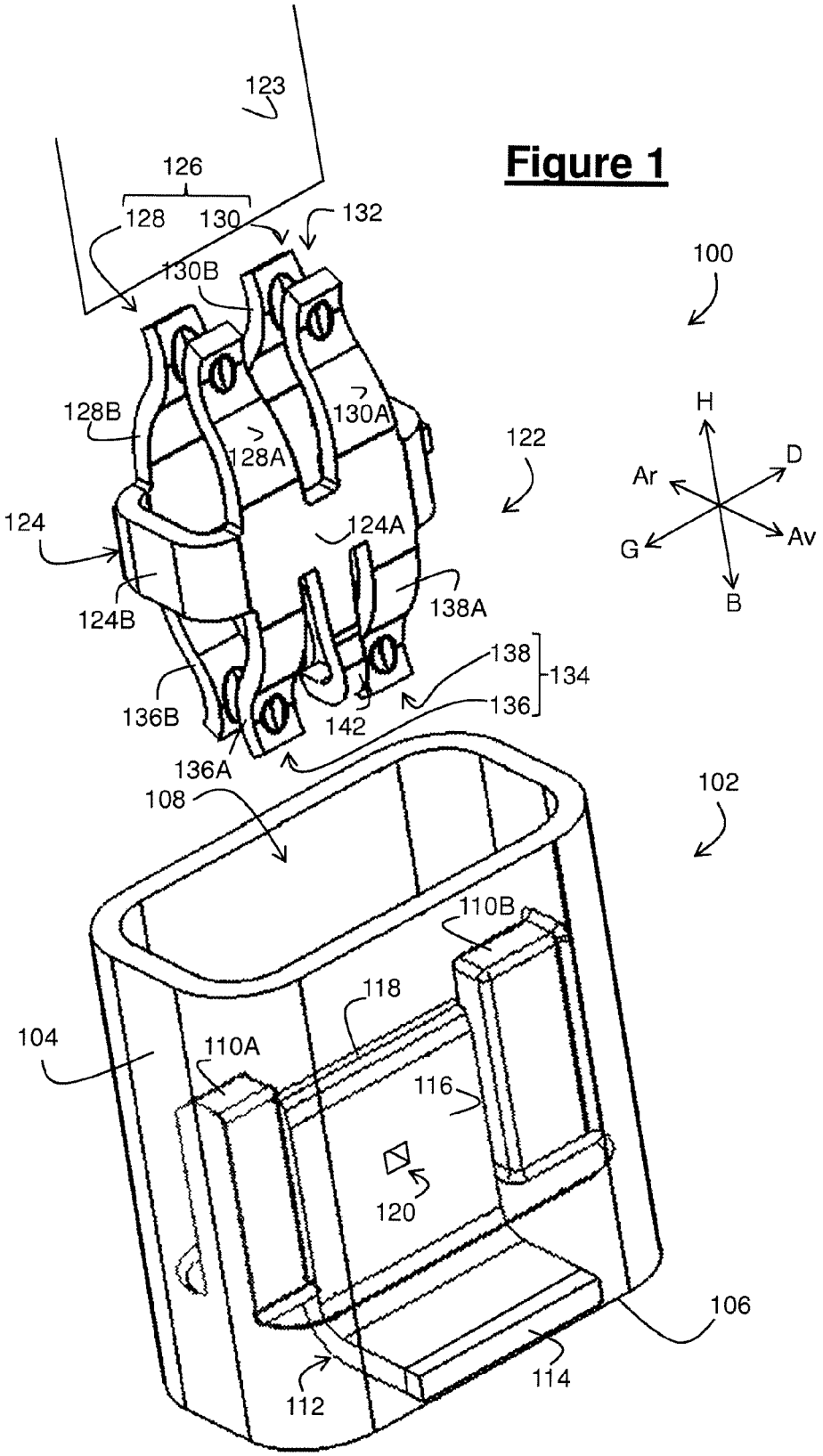
FIG. 1 is a three-dimensional view of an electrical connection system implementing the invention, the electrical connection system comprising a bus bar in a chamber and an electrical connector designed to come into contact with the bus bar, the interior of the chamber being visible due to the transparency of the chamber walls.

With reference to FIG. 1, the electrical connection system 100 firstly comprises a chamber 102.

The chamber 102 comprises lateral walls 104 and a bottom wall 106. The walls 104, 106 delimit an internal space of the chamber 102. The lateral walls 104 also delimit an opening 108 to the internal space of the chamber 102, this opening 108 being located opposite the bottom wall 106.

The chamber 102 also comprises two ledges 110A, 110B extending against the lateral walls 104, in the internal space of the chamber 102. Each ledge 110A, 110B has a stop surface facing towards the opening 108. In the example described, the two ledges 110A, 110B are arranged in a right/left R-L direction.

The electrical connection system 100 also comprises a first electrical conductor that is, in the example described, in the form of a bus bar 112. A bus bar is a low-impedance conductor to which several electrical circuits can be connected at separate points. The bus bar is in particular in the form of a strip.

The bus bar 112 passes through one of the lateral walls 104 of the chamber 102 in a sealed manner so as to have one external part 114 extending outside the chamber 102 and one internal part 116 extending inside the chamber 102. For example, the chamber 102 is overmolded around the bus bar 112. Thus, the opening 108 of the chamber 102 is the only unsealed opening of the chamber 102. The internal part 116 of the bus bar 112 has a shoulder and projects in the direction of the opening 108 of the chamber 102, between the two ledges 110A, 110B. The internal part 116 of the bus bar 112 has an end defining a male contact in the form of an electrical plug 118 pointing towards the opening 108. The plug 118 is flat and has two large opposing faces each provided with a cavity designed to receive a hook, as will be described later on. In the example described, the plug 118 is perforated by a through-hole 120 connecting its two large opposing faces. The two ends of the through-hole 120 define the two cavities respectively.

The electrical connection system 100 also comprises an electrical connector 122 designed to electrically connect together the bus bar 112 and another electrical connector 123 which, in the example described, is in the form of a flat electrical plug (male contact).

In the example described, the connector 122 is less than 20 mm in height (in the up/down U-D direction), 10 mm or 15 mm for example, and less that 15 mm in width (in the right/left R-L direction), 10 mm for example.

Connector 122 firstly comprises a body 124. In the example described, the body 124 is in the form of a ring around the up/down U-D direction, the ring having a general substantially hollow cylindrical form. In the context of this application, a cylinder means a cylinder of revolution or a prism such as a cube or a parallelepiped. The ring has a rectangular section with rounded corners. Alternatively, the ring could have a circular or oval section. The body 124 thus has two long sides 124A in the right/left R-L direction and two short sides 124B in the front/back F-B direction.

The connector 122 has a first contact 126 fixed to the body 124 and extending upwards from the body 124. In the example described, the first contact 126 is a female contact comprising two clamps 128, 130 open at the top, extending parallel to each other and defining a top slot 132 for the insertion of the electrical conductor 123. In other embodiments, the first contact 126 might comprise only one clamp. The slot 132 extends in the right-left direction. Each clamp 128, 130 comprises two contact branches 128A, 128B and 130A, 130B extending facing one another from the body 124, and more precisely from the two long sides 124A of the body respectively. The two contact branches 128A, 128B and 130A, 130B of the same clamp 128, 130 become closer to one other in the direction of their free ends in the manner of a lyre: each free end has a curved shape, the concavity of which faces outwards from the slot 132 so that the free ends offer a convex surface towards the inside of the slot 132. Each free end comprises a boss forming a bulge towards the inside of the slot 132. The boss thus allows a point-to-point contact between the contact branch 128A, 128B, 130A, 130B where it is located and the flat plug inserted in the slot 132. Each boss can be obtained by localized deformation of the free end, for example by stamping. The bosses allow electrical resistance to be minimized. The presence of two clamps 128, 130 allow the first contact 126 to adapt to the shape of the plug, for example if the latter is not completely flat or is of variable thickness.

The connector 122 also has a second contact 134 similar to the first contact 126. The second contact 134 is thus fixed to the body 124 and extends downwards from the body 124. In the example described, the second contact 134 is a female contact comprising two clamps 136, 138 open downwards, extending parallel to each other and defining a bottom slot 140 for the insertion of the plug 118 extending into the chamber 102. In other embodiments, the second contact 134 may comprise only one clamp. The slot 140 extends in the right/left direction. Each clamp 136, 138 comprises two contact branches 136A, 136B and 138A, 138B extending facing each other from the body 124. The two contact branches 136A, 136B and 138A, 138B of the same clamp 136, 138 become closer to each other in the direction of their free ends in the manner of a lyre: each free end has a curved shape, the concavity of which faces outwards from the slot 140 so that the free ends offer a convex surface towards the inside of the slot 140. Each free end comprises a boss forming a bulge towards the inside of the slot 140. The boss thus allows a point-to-point contact between the contact branch 136A, 136B, 138A, 138B where it is located and the plug 118 inserted in the slot 140. Each boss can be obtained by localized deformation of the free end, for example by stamping. The bosses allow electrical resistance to be minimized. The presence of two clamps 136, 138 allow the second contact 134 to adapt to the shape of the plug, for example if the latter is not completely flat or is of variable thickness.

In the example shown in FIG. 1, the connector 122 thus has two times two contact points with each of the plugs that it is designed to receive in order to connect them electrically together.

The connector 122 also has an attachment system of the connector 122 to the plug 118, this attachment system being distinct from the second contact 134. The attachment system is fixed to the body 124 and is designed to hook onto the plug 118 when the second contact 134 engages on the plug 118. The attachment system is fixed to the body 124 of the connector 122.

In the example described, the attachment system comprises two hooks 142, 144 fixed to the body 124 and extending downwards from the body 124, facing one another. More precisely, the two hooks 142, 144 are fixed respectively on the two long sides 124A of the body 124, each between the two clamps 136, 138. The hooks 142, 144 have free ends curved towards the slot 140, that are designed to engage respectively in the cavities of the plug 118 in order to hold the second contact 134 on the plug 118. The fact that the hooks are fixed facing each other and the fact that they are located between the clamps 136, 138 allows a stable connection to be achieved between the connector 122 and the plug 118.

Moreover, in the example described, the connector 122, and in particular the body 124, the two contacts 126, 134 and the hooks 142, 144 are formed from a single plate or sheet of metal, bent and/or stamped and/or punched. The connector 122 thus forms a one-piece assembly. The metal used can be of any appropriate sort and in particular have surface treatments to suit the manner in which the connector 122 is fixed onto the plug 118. The plate/sheet of metal is preferably less than 1.5 mm thick, for example between 0.6 mm and 1 mm.

Thus, the body 124 comprises a band wound on itself to form a cylinder. The band has two long sides and two end short sides. The branches 128A, 128B, 130A, 130B, 136A, 136B, 138A, 138B of the clamps 128, 130, 136, 138 and the hooks 142, 144 are formed respectively by tongues projecting from the long sides of the band.

Figure 2:
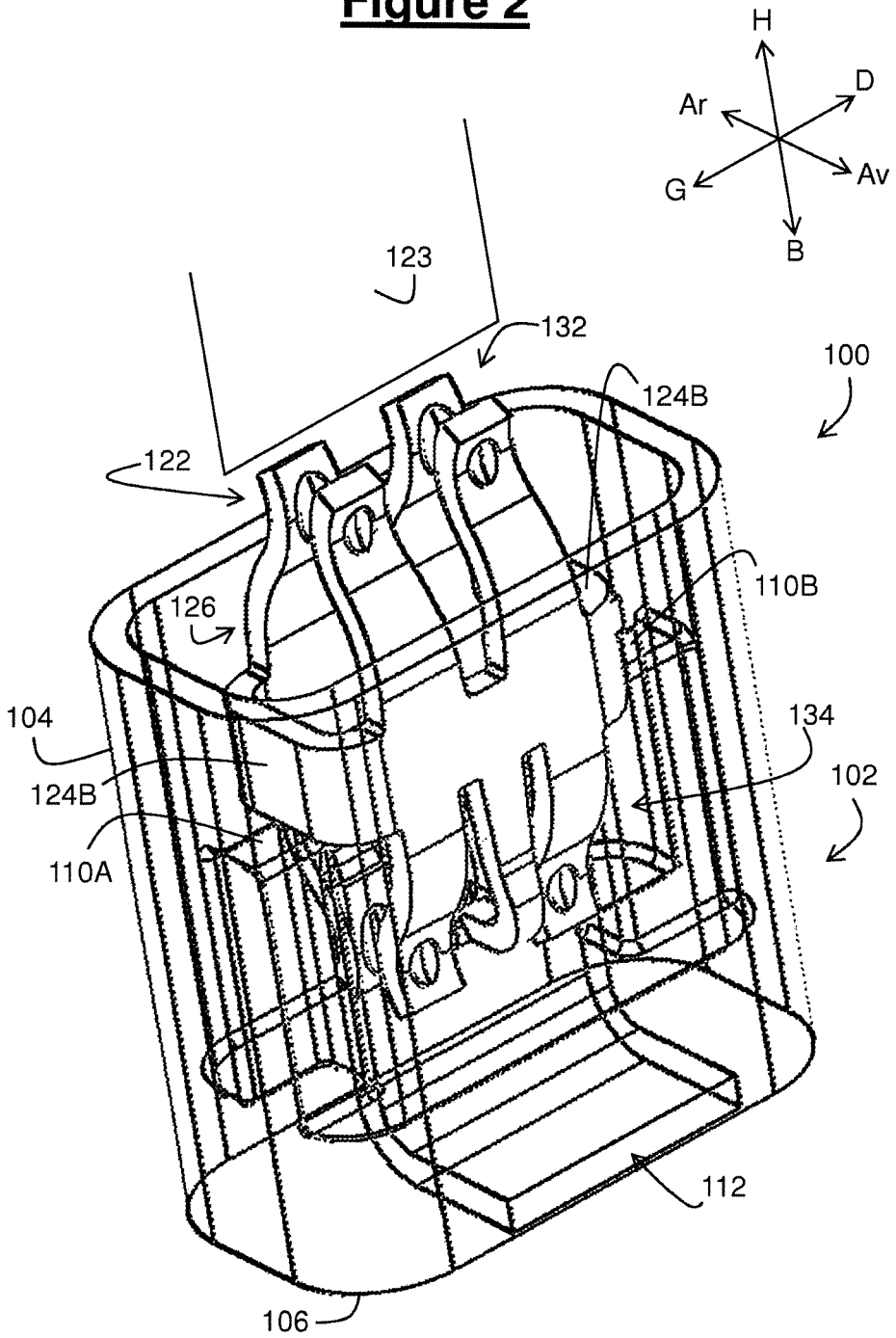
FIG. 2 is a view similar to that of FIG. 1, in which the connector is engaged on the bus bar.

With reference to FIG. 2, the connector 122 is designed to be introduced into the chamber 102 and to contact the plug 118 in order to establish an electrical connection.

More precisely, the plug 118 is designed to enter the slot 140 on insertion of the connector 122 into the opening 108. In doing so, the plug 118 moves apart the branches 136A, 136B, 138A, 138B of the clamps 136, 138 of the second contact 134, as well as the two hooks 142. The branches 136A, 136B, 138A, 138B are flexible so as to ensure a good contact force. Thus the clamps 136, 138 of the second contact 134 fit tightly around the plug 118.

The connector 122 is inserted until the short sides 124B of the body 124 are stopped by the stop surfaces of the ledges 110A, 110B and rest thereon. The presence of two ledges 110A, 110B on two opposite lateral walls 104 of the chamber 102 allow the inclination of the connector 122 to be controlled around the forward/backward F-B direction.

At the moment of being stopped by the ledges 110A, 110B, the two hooks 142, 144 engage respectively in the two cavities formed by the through-hole 120 so as to hold the connector 122 in place on the plug 118, in the chamber 102.

Preferably, the ledges 110A, 1106 are smaller than the short sides 124B of the body 124 of the connector 122. Thus, the connector 122 can pivot on the ledges 110A, 1106 around the right/left R-L direction in order, for example, to take up any play.

It is then possible to insert the other electrical conductor 123 in the slot 132 of the first contact 126, in the same way as the plug 118 with the second contact 134, so as to achieve an electrical connection between this other electrical conductor 123 and the bus bar 112 via the connector 122.

Figure 3:
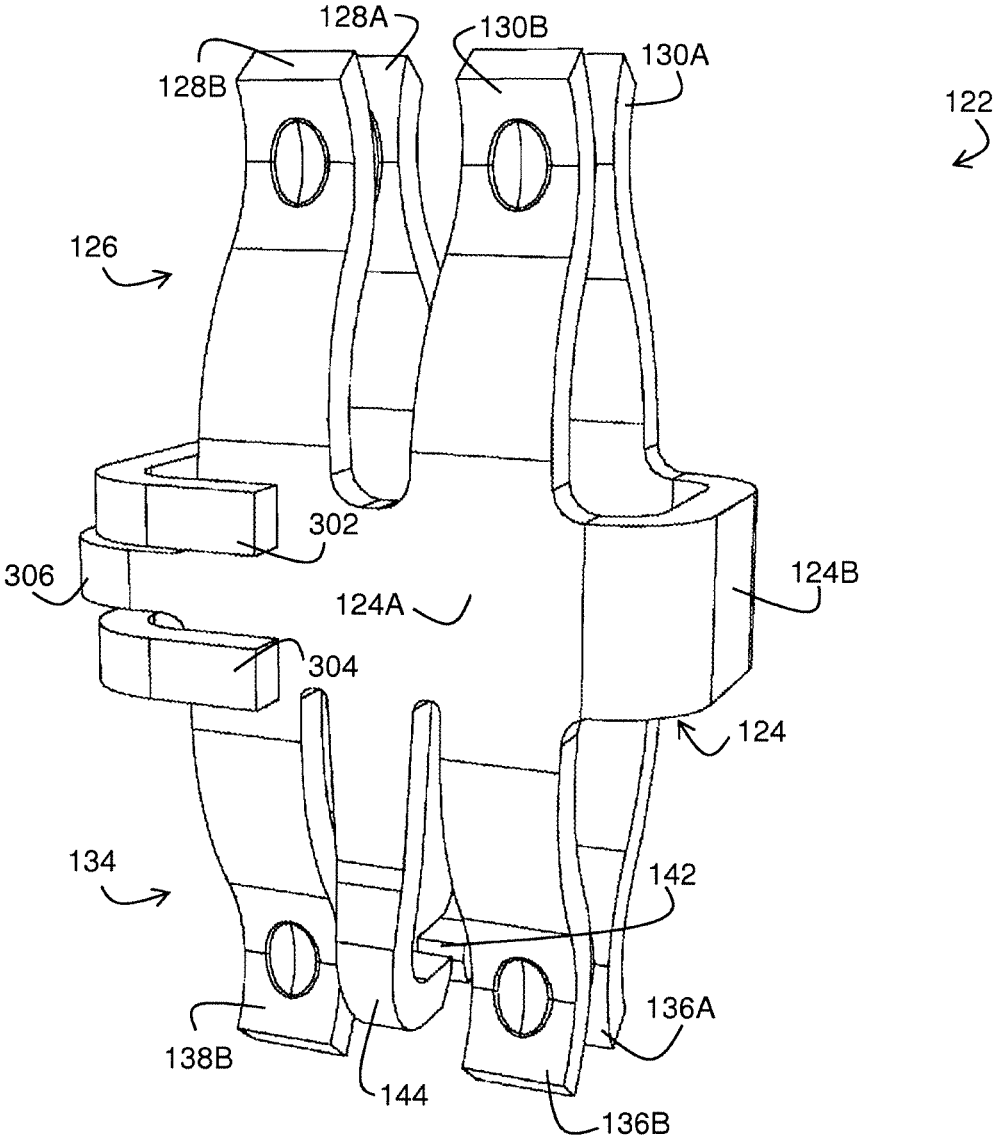
FIGS. 3 and 4 are three-dimensional views of the connector.
Figure 4:
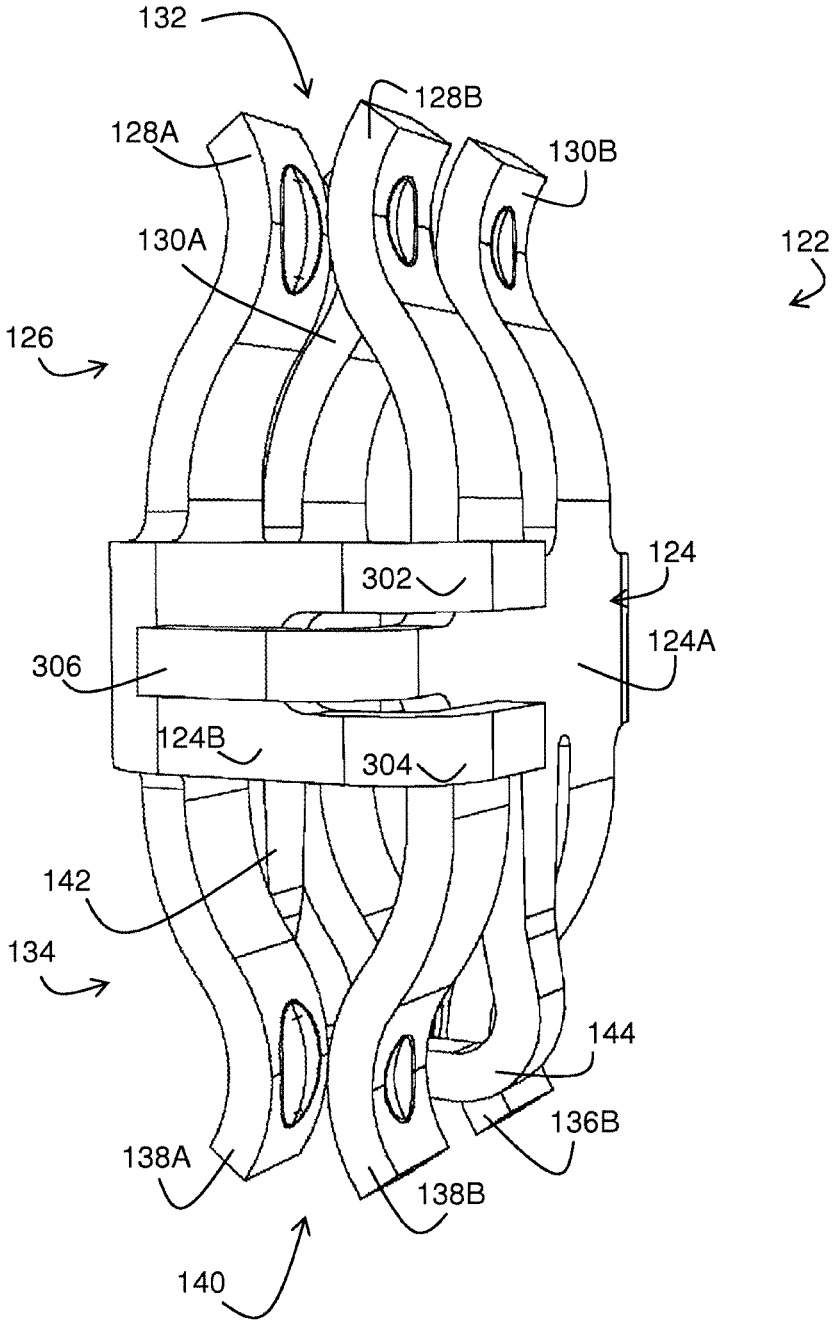

With reference to FIGS. 3 and 4, the body 124 of the connector 122 also comprises fingers 302, 304, 306 extending from the short sides of the band of the body 124. The fingers 302, 304, 306 are designed to engage with each other in order to keep the band wound around when, in particular, the plugs are inserted in the clamps of contacts 126, 134. In the example described, a first short side has two fingers 302, 304 whereas the other short side has one finger designed to insert itself between the two fingers 302, 304.

The electrical connection system 100 can for example be used to connect a supply unit to a power-steering motor of a motor vehicle. In this case, the bus bar is electrically connected to one among the supply unit and the motor, while the electrical conductor 123 belongs to another bus bar connected electrically to the other among the supply unit and the motor.

The invention is of particular interest in this case because, firstly, the supply unit and the power-steering motor are usually in a cluttered environment so that the bus bar 112 is difficult to access. This problem is solved by the fact that connector 122 is guided by the lateral walls 104 of the chamber and hooks automatically into the bus bar 112 when it is inserted in the chamber. Furthermore, when assembling the motor vehicle, it is often necessary to unplug the supply unit and plug it back in several times in order to perform, for example, tests or adjustments. Now, the first contact 126 can receive the electrical conductor 123 in a removable manner, which means that this electrical conductor can easily be disengaged from the first contact 126.

This invention is not limited to the embodiment described above but is, by contrast, defined by the claims below. In fact, it will be clear to a person skilled in the art that modifications can be made thereto.

In particular, contacts 126, 134 could be male contacts designed to be received in female contacts. In this case, the internal part 116 of the bus bar 112 could have a female contact.

Furthermore, the hook or hooks 142, 144 could be carried by the plug 118, while the system of attaching the connector would comprise one or more cavities in which the hook or hooks could respectively be designed to engage.

Moreover, the terms used in the claims must not be regarded as limited to the elements of the embodiment described above, but must by contrast be regarded as covering all of the equivalent elements that a person skilled in the art can deduce from his general knowledge.

LIST OF REFERENCE NUMERALS

Electrical connection system 100
Chamber 102
Lateral walls 104
Bottom wall 106
Opening 108
Ledges 110A, 110B
Electrical conductor (bus bar) 112
External part of bus bar 114
Internal part of bus bar 116
Electrical plug 118
Through-hole 120
Electrical connector 122
Electrical conductor 123
Body of electrical connector 124
Sides of body 124A, 124B
First contact 126
Clamps of first contact 128, 130
Branches of clamps 128, 130 128A, 128B, 130A, 130B
Top slot 132
Second contact 134
Clamps of second contact 136, 138
Branches of clamps 136, 138 136A, 136B, 138A, 138B
Bottom slot 140
Attachment system (hooks) 142, 144
Fingers 302, 304, 306
Key to FIGS. 1 & 2
H U
B D
Ar Backward
Av Forward
G L
D R

The invention claimed is:

1. An electrical connector configured to connect a first electrical conductor and a second electrical conductor together electrically, the electrical connector comprising:

a body;

a first contact fixed to the body and configured to contact the first electrical conductor;

a second contact fixed to the body and configured to contact the second electrical conductor; and a system attaching the electrical connector to the second electrical conductor, the attachment system being separate from the second contact and fixed to the body, wherein the body, the first contact, the second contact, and the attachment system are formed from one plate or sheet of metal, folded and/or stamped.

2. The electrical connector according to claim 1, wherein the second contact is a female contact.

3. The electrical connector according to claim 1, wherein the second contact comprises at least one clamp.

4. The electrical connector according to claim 3, wherein the attachment system comprises at least one hook fixed to the body and configured to engage in a cavity made in the second electrical conductor to hold the electrical connector on the second electrical conductor.

5. The electrical connector according to claim 4, wherein the second contact comprises two clamps and wherein the hook is located between the two clamps.

6. The electrical connector according to claim 4, wherein the attachment system comprises two hooks extending facing one another and between which the second electrical conductor is configured to be inserted.

7. The electrical connector according to claim 1, wherein the first contact is a female contact.

8. The electrical connector according to claim 1, wherein the first contact comprises at least one clamp.

9. The electrical connector according to claim 1, wherein the two contacts are located respectively on two opposite sides of the body.

10. An electrical connection system comprising:

a chamber comprising walls delimiting an opening into an internal space of the chamber;

and the electrical connector as claimed in claim 1, configured to be inserted at least partly into the internal space of the chamber through the opening of the chamber, and in which the second contact is designed to contact the internal part of the electrical conductor, and wherein the first electrical conductor passes through one of the walls of the chamber so as to have an outer part on the outside of the chamber, and an internal part extending into the internal space of the chamber.

11. The electrical connection system according to claim 10, wherein the first electrical conductor passes through the wall of the chamber in a sealed manner, and wherein the opening of the chamber is the only unsealed opening of the chamber.

12. The electrical connection system according to claim 10, wherein the chamber comprises at least one ledge extending into the internal space of the chamber and configured to stop the electrical connector in the internal space of the chamber.

13. The electrical connection system according to claim 10, wherein the attachment system comprises at least one hook fixed to the body and configured to engage in a cavity made in the second electrical conductor to hold the electrical connector on the second electrical conductor, and wherein the internal part of the first electrical conductor is equipped with one or more cavities in which the hook or hooks are respectively configured to engage.

14. An electrical connector configured to connect a first electrical conductor and a second electrical conductor together electrically, the electrical connector comprising:

a body;

a first contact fixed to the body and configured to contact the first electrical conductor;

a second contact fixed to the body and configured to contact the second electrical conductor; and a system attaching the electrical connector to the second electrical conductor, the attachment system being separate from the second contact, wherein the second contact comprises at least one clamp, and wherein the attachment system comprises at least one hook fixed to the body and configured to engage in a cavity made in the second electrical conductor to hold the electrical connector on the second electrical conductor.

15. The electrical connector according to claim 14, wherein the second contact comprises two clamps and wherein the hook is located between the two clamps.

16. The electrical connector according to claim 14, wherein the attachment system comprises two hooks extending facing one another and between which the second electrical conductor is configured to be inserted.

* * * * *